US006076683A

United States Patent [19]

Okada et al.

[11] Patent Number: 6,076,683

[45] Date of Patent: Jun. 20, 2000

[54] SORTER MECHANISM

[75] Inventors: Goro Okada, Louisville, Ky.; Ronald T. Rutz, Oradell, N.J.

[73] Assignee: Sandvik Sorting Systems, Inc., Louisville, Ky.

[21] Appl. No.: 08/960,622

[22] Filed: Oct. 29, 1997

(Under 37 CFR 1.47)

[51] Int. Cl.[7] ..... B07C 5/00; B07C 9/00

[52] U.S. Cl. ..... 209/656; 209/577; 209/583; 209/657

[58] Field of Search ..... 209/559, 583, 209/584, 656, 657, 577; 198/580

[56] References Cited

U.S. PATENT DOCUMENTS

| | | | |
|---|---|---|---|
| 2,728,466 | 12/1955 | Postlewaite et al. | 198/580 X |
| 3,612,250 | 10/1971 | Thompson . | |
| 3,642,117 | 2/1972 | Burt | 209/539 X |
| 3,955,678 | 5/1976 | Moyer | 209/73 |
| 4,039,074 | 8/1977 | Maxted . | |
| 4,058,217 | 11/1977 | Vaughan et al. . | |
| 4,227,607 | 10/1980 | Malavenda | 198/460.1 |
| 4,690,751 | 9/1987 | Umiker | 209/3.3 |
| 5,101,983 | 4/1992 | Seata | 209/583 |
| 5,240,101 | 8/1993 | LeMay et al. . | |
| 5,372,238 | 12/1994 | Bonnet | 209/900 X |
| 5,701,989 | 12/1997 | Boone et al. . | |
| 5,737,438 | 4/1998 | Zlotnick | 209/583 |
| 5,738,202 | 4/1998 | Ydoate et al. . | |
| 5,887,699 | 3/1999 | Tharpe | 209/540 |

*Primary Examiner*—Donald P. Walsh
*Assistant Examiner*—Brett Martin
*Attorney, Agent, or Firm*—Burns, Doane, Swecker & Mathis, L.L.P.

[57] ABSTRACT

Coded articles are conveyed through an orienting section which tends to arrange the articles in single-file, spaced apart relationship. The articles are then conveyed through a reader/sensor mechanism where the codes are read and the spatial relationship of the packages is determined. Articles which are both properly scanned and properly spaced are conveyed to respective branch lines of a sorter section in accordance with information gleaned from the codes. Articles which are improperly scanned or improperly spaced are diverted to a recycle conveyor by a recycle diverter device located upstream of the sorter section and are re-routed back to the orienting section.

10 Claims, 2 Drawing Sheets

SORTER MECHANISM

BACKGROUND OF THE INVENTION

The present invention relates to a sorter mechanism for sorting coded articles in accordance with information gleaned from a scanning of the codes.

A conventional automated article sorting system depicted in FIG. 2 comprises an orienting apparatus 10A which receives coded articles and transforms the articles from a randomly oriented state into a single-file relationship having a predetermined spacing between successive articles. The articles could, for example, comprise packages to be mailed.

The orienting apparatus 10A delivers the packages P to a conventional scanner 12A which reads a code imprinted on each package, which code could correspond to a mailing address. The packages are then conveyed on a downstream sorter conveyor 14 toward a sorter section which comprises branch lines 16–18, etc. Disposed at the entrance of each branch line is a diverter paddle 20 which is actuated by a control mechanism 21 in response to a signal from the scanner to divert packages to respective branch lines corresponding to the addresses read by the scanner.

In some instances, a proper scanning does not take place. For example, the code may be obscured or missing, or perhaps two packages pass the scanner too closely together whereupon a double scanning takes place. In such a case, the packages that have been improperly scanned are permitted to travel along the downstream conveyor segment 14 past the deflector paddles 20 to a collection zone 22 where a human operator manually inspects the collected packages and takes steps to see that they reach the proper branch line.

During operation of the system, an appreciable number of improperly scanned packages may reach the collection zone, thereby creating substantial work for human personnel, thereby detracting from the automated nature of the system.

Thompson et al. U.S. Pat. No. 3,612,250 discloses that packages that have passed through a sorter section without having been diverted (sorted) are diverted to a recirculation conveyor which sends the packages back through the sorter section. Any package that fails to be diverted is sent to a reject area for manual sorting. A shortcoming of such a mechanism is that it does not prevent packages from being passed through the sorter section in improperly spaced relationship. That is, even when efforts are made to supply packages to the sorter section in single file relationship and spaced apart by a certain minimum spacing, it can occur that some packages are supplied in side-by-side relationship (abreast), or that a package may trail a leading package too closely. If the packages are traveling abreast, both will be diverted to a branch line, even if only one of the packages is supposed to be diverted to that line. Furthermore, in the case when an article trails a leading article too closely, a diverter mechanism at one of the branch lines might not be able to react quickly enough, when diverting the leading article, to avoid also striking the trailing article (in error); or if actuated to divert only the trailing article, the diverter might also strike the leading article and displace it from its proper place on the conveyor. Furthermore, since all packages, whether scannable or not, are passed through the sorter section, the capacity of the sorter conveyor must have a high capacity.

Vaughan et al. U.S. Pat. No. 4,058,217 discloses a baggage handling system wherein coded tags are applied to the bags which reflect the bag destination. Bags which are not properly scanned are diverted to a recycle conveyor at a location upstream of a sorter section where they are sent to a manual sorting position. At that position, a human operator makes an appropriate correction of each diverted bag, and the recycle conveyor returns the bags into the main stream to be rescanned. However, such a mechanism still requires that an operator personally inspect every improperly scanned bag.

It would be desirable to ensure that only packages that are properly spaced apart are delivered to the sorter section, and further that the capacity of the sorter conveyor is minimized, and further that the number of articles required to be inspected or sorted by human personnel is minimized.

SUMMARY OF THE INVENTION

One aspect of the present invention relates to a method of conveying and sorting coded articles. The method comprises the steps of:

A) conveying the articles through an orienting mechanism for orienting the articles in single file and at predetermined intervals; thereafter B) conveying the articles past a reading/sensing mechanism which reads codes on the articles and senses improperly spaced articles; thereafter C) conveying properly read and properly spaced articles to respective branch lines of a sorter section in accordance with data read from the codes;

D) diverting, at a location upstream of the sorter section, improperly read articles and improperly spaced articles; and E) conveying the diverted articles back to the reader mechanism.

Preferably the step of sensing improperly spaced articles comprises sensing articles traveling abreast of one another and/or sensing an improper interval between successive articles.

Another aspect of the invention involves an apparatus for conveying and sorting coded articles. The apparatus comprises an orienting mechanism for orienting the articles in single file and at predetermined intervals; reading/sensing mechanism disposed downstream of the orienting mechanism for reading codes on the articles and sensing improperly spaced articles; a sorter section, including a plurality of branch lines, disposed downstream of the reading/sensing mechanism; a plurality of diverting means disposed at respective branch lines for diverting, onto respective branch lines, articles that have been both properly read and properly spaced; a recycle conveyor arranged to convey articles to the orienting mechanism; and a recycle diverter arranged between the reading/sensing mechanism and the sorter section for diverting improperly read articles and improperly spaced articles onto the recycle conveyor.

The reading/sensing mechanism preferably includes means for sensing articles traveling abreast, and/or means for sensing an improper interval between successive articles.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 1:
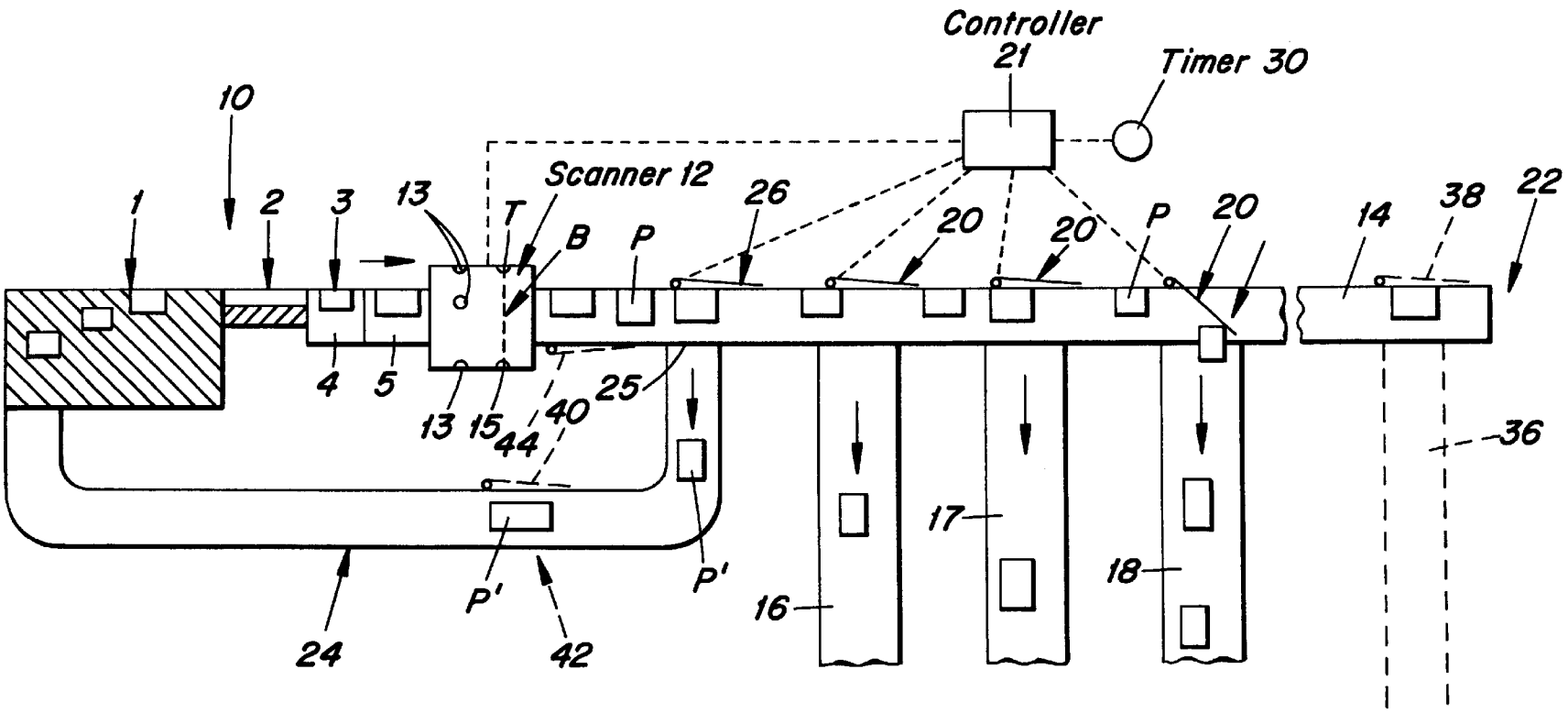
FIG. 1 is a schematic top plan view of a conveying system according to the present invention.
Figure 2:
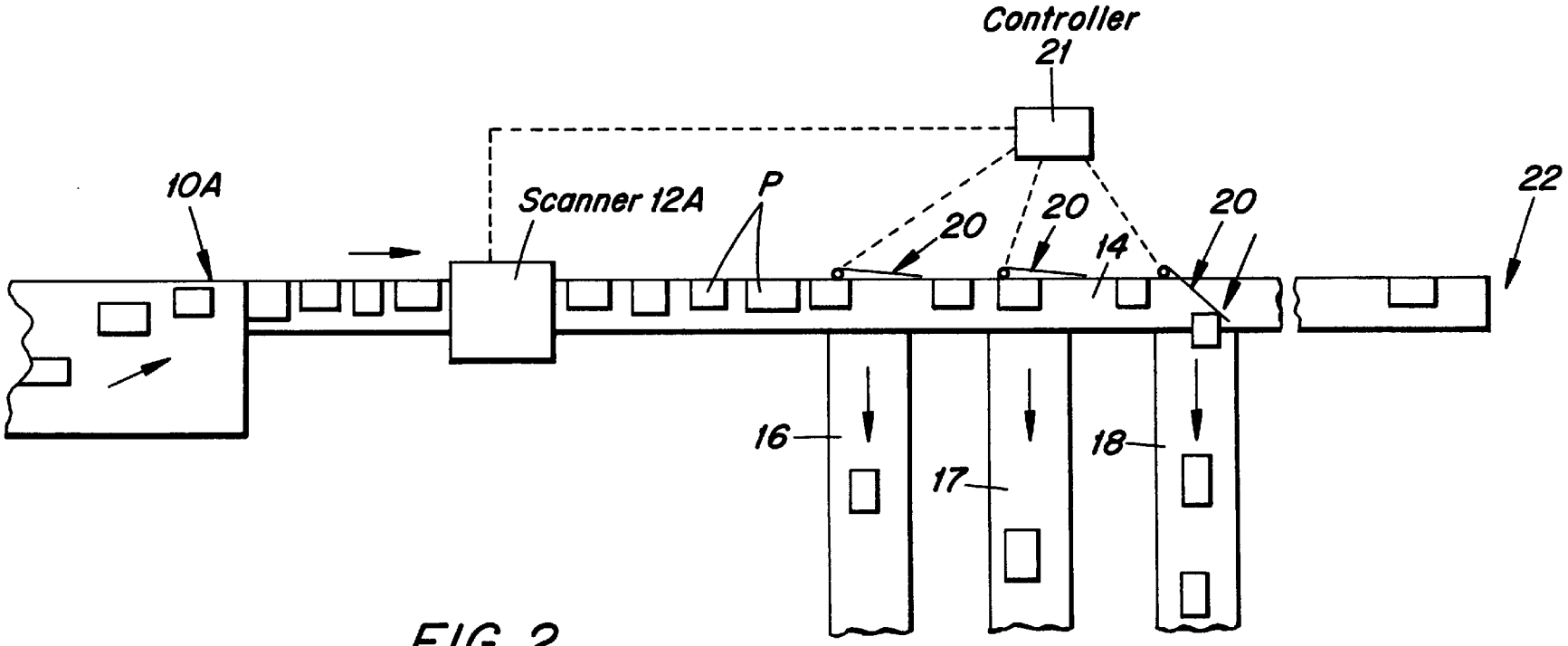
FIG. 2 (PRIOR ART)
FIG. 2 is a view similar to FIG. 1 of a prior art conveying system.

A conveying system depicted in FIG. 1 includes an orienting apparatus 10 which arranges articles in single file and spaced apart by a desired spacing. For example, the orienting apparatus may comprise a singular conveyor 1 of the type disclosed in U.S. Pat. Nos. 4,039,074 or 5,240,101, a side-by-side eliminator 2 of the type disclosed in U.S. Pat. No. 5,701,989, issued Dec. 30, 1997, and a flow control conveyor section 3 of the type disclosed in U.S. Pat. No. 5,738,202, issued Apr. 14, 1998. The disclosures of those documents are incorporated by reference herein.

The singulator conveyor 1 tends to orient the articles longitudinally and in generally single-file relationship. The side-by-side eliminator 2 conveys articles such that if articles are traveling side-by-side (abreast), the outer article tends to be removed. The flow control conveyor 3 includes first and second conveyors 4, 5. The second conveyor 5 travels faster than the first conveyor 4 to create a minimum spacing between successive articles.

Disposed downstream of the orienting apparatus 10 are a reading/sensing mechanism 12, a sorter conveyor 14, branch lines 16–18, and diverter paddles 20.

The reading/sensing mechanism 12 includes an array of scanners or readers 13 and a sensor 15. The scanners 13, such as conventional laser readers which scan the tops and sides of packages, read a code imprinted on each package. The code may correspond to a mailing address in the case of mailed packages, for example. Despite efforts to provide a readable code on each package, it is possible that some packages may not be coded, or that the codes are not readable. The scanners will detect packages that cannot be properly scanned.

Furthermore, despite efforts taken for causing packages to enter the mechanism 12 in single-file, properly spaced relationship, that may not always be the case. That is, it is possible that packages may be traveling abreast, or a package may be trailing too closely behind a leading package. That can result in the problems described earlier herein, e.g., packages being inadvertently diverted to incorrect branch lines in the sorter section.

The present invention deals with that problem by detecting packages traveling abreast, and detecting a packages trailing too closely to their respective leading packages, and diverting those packages onto a recirculation conveyor 24 at a location 25 upstream of the sorter section. Thus, only packages which have been properly scanned and which are traveling in proper spatial relationship are transmitted to the sorter section. All other packages are diverted to the recirculation conveyor.

The sensor 15 comprises a conventional infrared sensor which receives an infrared beam B that is transmitted from an infrared transmitter T. When a package breaks the beam, the presence of the package is sensed. This enables the presence of packages traveling abreast, and the presence of a package trailing too closely behind a leading package, to be sensed.

For example, if packages are traveling abreast, the readers 13 will scan two codes, but the sensor 15 will sense only one package. Signals from the readers and scanners are fed to a controller 21 which determines therefrom that packages must be traveling side-by-side (abreast). The controller actuates the diverter 26 for diverting both of the side-by-side packages to the recirculation conveyor 24.

Furthermore, the sensor 15 supplies the controller 21 with a signal each time that the front edge of a package breaks the infrared beam B. Thus, the controller, knowing the speed of the conveyor on which the packages are being passed through the scanner, can determine whether there exists a proper interval between successive packages. For example, an interval between the front edges of successive packages should be no less than a certain amount to ensure that each sorter diverter 20 can divert one of the packages without striking a successive package. If a package is trailing another package too closely, the controller actuates the recycle diverter paddle 26 to divert the trailing package onto the recirculation conveyor 24.

The recirculation conveyor 24 transports packages P' thereon directly back to the singulator 1. By "directly" is meant in the absence of human intervention, i.e., no human operator needs to inspect the codes of the packages P' as they are being recycled.

It will be appreciated that some of the recycled packages will be properly rescanned and sent to their respective branch conveyors, but that others of the recycled packages will be recycled continuously e.g., due to a missing or damaged code. Eventually, those packages will accumulate and, if not dealt with, may overburden the recycle conveyor.

Accordingly, in accordance with the present invention, packages are purged from the recycle conveyor after a predetermined period of operation of the system. To perform that function, the controller 21 prevents the recycle diverter paddle from diverting packages having codes that cannot be properly scanned, during a purge period. However, during the purge period, the controller will continue to cause packages traveling abreast or too closely to a leading package to be diverted to the recycle conveyor. The purge period preferably corresponds to a time required for a package to travel from the inlet 25 of the recycle conveyor 24 back to the recycle diverter paddle 26. That ensures that there will occur a complete purging of all of the accumulated recycled (faulty) packages P' which cannot be properly scanned. After traveling past the deactivated recycle diverter paddle 26, the faulty packages will travel on the downstream conveyor section 14 to a collection zone 22. At the collection zone 22, a human operator will examine the packages and take the necessary steps for ensuring that they are transferred to the respective branch line.

During the purge period, any packages which are properly scanned and properly spaced apart will be directed to the appropriate branch lines.

It will be appreciated that the purge period need not be for the full period that it takes for a package to travel from the inlet of the recycle conveyor back to the recycle diverter paddle 26, but rather could be for a shorter time if desired.

Instead of locating the collection zone 22 at the terminal end of the conveyor belt, a separate collection branch line could be provided, having a respective diverter paddle for diverting all improperly scanned packages to the collection branch line for conveyance to a collection zone.

Alternatively, a diverter paddle 40 (shown in phantom lines in FIG. 1) could be provided for knocking packages off the recycle conveyor 24 and into a collection zone 42. Other arrangements could be provided such as a diverter paddle 44 arranged immediately downstream of the scanner for knocking the packages off the conveyor segment 14 and into a collection zone.

In operation, the mechanism 12 scans the codes of coded packages P and determines the relative positions of the packages. Packages which are both properly scanned and properly spaced are directed to respective branch lines 16–18, etc., in accordance with information received from the codes. Improperly scanned packages P', or packages not properly spaced (i.e., packages traveling abreast or too closely behind another package), are directed to the recycle conveyor 24 and sent back to the orienting apparatus 10 for realignment and rescanning. Some of the rescanned packages will be properly scanned and sent to the appropriate branch lines, while others are again recycled. Eventually, the recycle conveyor is purged of packages that cannot be properly scanned by directing those packages to the collection zone 22 for manual inspection.

In accordance with the present invention, packages that are not properly spaced, i.e., packages traveling abreast or trailing another package too closely, are prevented from being delivered to the sorter section, thereby avoiding a mis-sorting or accidental striking of the packages by the sorter paddles. Also, the number of improperly scanned packages requiring inspection by a human operator is reduced, because of the automatic rescanning which takes place. Hence, less non-automated activity is necessary. This is achieved without overburdening the recycle conveyor since purging is automatically effected every so often.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A method of conveying and sorting coded articles, comprising the steps of:

A) conveying non-oriented articles through an orienting mechanism for orienting the non-oriented articles in single file and at predetermined intervals; thereafter B) conveying the articles past a reading/sensing mechanism which reads codes on the articles and senses a spacing between successive articles; thereafter (C) conveying properly read and properly spaced articles to respective branch lines of a sorter section in accordance with data read from the codes;

(D) diverting, at a location upstream of the sorter section, improperly read articles and improperly spaced articles; and (E) conveying the diverted articles back to the orienting mechanism.

2. The method according to claim 1, wherein the step of sensing improperly spaced articles comprises sensing articles traveling abreast of one another.

3. The method according to claim 2, wherein the step of sensing improperly spaced articles further comprises sensing an improper interval between successive articles.

4. The method according to claim 1, wherein the step of sensing improperly spaced articles comprises sensing an improper interval between successive articles.

5. The method according to claim 1 further including the steps of repeating steps A, B, C, and D for a period of time, and thereafter automatically directing improperly scanned articles to a collection site for manual inspection.

6. An apparatus for conveying and sorting coded articles, comprising:

an orienting mechanism for orienting non-oriented articles in single file and at predetermined intervals;

a reading/sensing mechanism disposed downstream of the orienting mechanism for reading codes on the articles and sensing a spacing between successive articles;

a sorter section, including a plurality of branch lines disposed downstream of the reading/sensing mechanism;

a plurality of diverters disposed at respective branch lines for diverting, onto respective branch lines, articles that are properly read and properly spaced;

a recycle conveyor arranged to convey articles to the orienting mechanism; and a recycle diverter arranged between the reading/sensing mechanism and the sorter section for diverting improperly read articles and improperly spaced articles onto the recycle conveyor.

7. The apparatus according to claim 6, wherein the reading/sensing mechanism includes means for sensing articles traveling abreast.

8. The apparatus according to claim 7, wherein the reading/sensing mechanism further includes means for sensing an improper interval between successive articles.

9. The apparatus according to claim 6, wherein the reading/sensing mechanism includes means for sensing an improper interval between successive articles.

10. The apparatus according to claim 6 and further including a controller connected to the reader/sensing mechanism and the recycle diverter for automatically periodically deactivating the recycle diverter from diverting improperly read articles for a period of time, whereupon the improperly read articles are directed to a collection site for manual inspection.

* * * * *